US010442075B2

(12) United States Patent
Moreau et al.

(10) Patent No.: US 10,442,075 B2
(45) Date of Patent: Oct. 15, 2019

(54) TOOL PACK SYSTEM WITH REMOVABLE TOOL PANELS

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: TY-FLOT, INC., Manchester, NH (US)

( * ) Notice: Subject to any disclaimer, the term of this patent is extended or adjusted under 35 U.S.C. 154(b) by 191 days.

(21) Appl. No.: 15/165,080

(22) Filed: May 26, 2016

(65) Prior Publication Data

US 2017/0341215 A1 Nov. 30, 2017

(51) Int. Cl.
*B25H 3/00* (2006.01)
*A45F 3/04* (2006.01)
(Continued)

(52) U.S. Cl.
CPC ..... *B25H 3/00* (2013.01); *A45C 7/0086* (2013.01); *A45C 13/02* (2013.01); *A45C 13/023* (2013.01);
(Continued)

(58) Field of Classification Search
CPC . A45C 2013/026; A45C 13/02; A45C 13/103; A45C 2013/1015; A45C 13/023;
(Continued)

(56) References Cited

U.S. PATENT DOCUMENTS 1,742,656 A * 1/1930 Laprade ..... A45C 13/03 190/110
4,385,418 A * 5/1983 Loftis ..... E05D 5/12 16/381
(Continued)

FOREIGN PATENT DOCUMENTS

CA 2635328 A1 12/2009
CN 202151174 U 2/2012
EP 2233254 A1 * 9/2010 ..... A45C 13/02

OTHER PUBLICATIONS

Mil-Spec Monkey Store, AustriAlpin Cobra Buckle, available at http://milspecmonkey.com (admitted prior art).
(Continued)

*Primary Examiner* — Nathan J Newhouse
*Assistant Examiner* — Matthew T Theis
(74) *Attorney, Agent, or Firm* — Dicke, Billig & Czaja, PLLC

(57) ABSTRACT

A pack system adapted for carrying hand tools includes a tool-carrying container constructed to be worn on a user's person and having a container base portion, a first shell portion, a second shell portion, and a releasable closure with a first closure part connected to the first shell portion and a second closure part connected the second shell portion. The tool-carrying container is operable between an open-container position and a closed-container position in which it defines and encloses a main storage compartment. At least one tool panel is removably disposed within the main storage compartment and has one or more tool receivers each constructed to retain a hand tool. A panel-retaining structure has a first retaining portion secured to the tool panel(s) and a second retaining portion secured inside of the tool-carrying container. The panel-retaining structure releasably retains the tool panel(s) in the main storage compartment.

18 Claims, 4 Drawing Sheets

(51) Int. Cl.

| | |
|---|---|
| ***A45C 13/02*** | (2006.01) |
| ***A45C 13/10*** | (2006.01) |
| ***A45C 7/00*** | (2006.01) |
| *A45F 3/00* | (2006.01) |

(52) U.S. Cl.
CPC ..... *A45C 13/103* (2013.01); *A45F 3/04* (2013.01); *A45C 2013/026* (2013.01); *A45C 2013/1015* (2013.01); *A45F 2003/003* (2013.01)

(58) Field of Classification Search
CPC .... A45C 7/0086; A45F 3/04; A45F 2003/001; A45F 2003/003; B25H 3/00; B25H 3/021
USPC ..... 224/223, 242, 651, 245, 650, 684, 647
See application file for complete search history.

(56) References Cited

U.S. PATENT DOCUMENTS

| | | | | |
|---|---|---|---|---|
| 5,209,384 | A | 5/1993 | Anderson | |
| 6,076,641 | A * | 6/2000 | Kinzer | A45C 5/14 16/18 CG |
| 6,126,003 | A | 10/2000 | Brouard | |
| 6,915,902 | B2 | 7/2005 | Brouard | |
| 7,328,905 | B2 * | 2/2008 | Guirlinger | B25H 3/00 280/35 |
| 9,629,446 | B2 * | 4/2017 | Moreau | A45F 5/004 |
| 2007/0114150 | A1 | 5/2007 | Lin | |
| 2008/0029562 | A1 | 2/2008 | Hawkins | |
| 2011/0147428 | A1 * | 6/2011 | Crawford | A45C 11/24 224/584 |
| 2013/0292432 | A1 * | 11/2013 | Stevens | A45F 3/04 224/184 |

OTHER PUBLICATIONS

Klein Tools, Tradesman Pro Tech Backpack, Cat. No. 55439BPTB, available at http://www.kleitools.com/catalog/ (admitted prior art).
Klein Tools, Tradesman Pro Organizers Brochure (admitted prior art).
Veto Pro Pac, Tech Pac Product Sheet, known of prior to May 26, 2016, 1 page, retrieved from vetopropac.com.
Non-Final Office Action for U.S. Appl. No. 15/429,260 dated Apr. 4, 2018; 18 pages.
Notice of Allowance for U.S. Appl. No. 15/429,260 dated Aug. 29, 2018; 5 pages.

* cited by examiner

TOOL PACK SYSTEM WITH REMOVABLE TOOL PANELS

BACKGROUND OF THE INVENTION

1. Field of the Invention

The present invention relates generally to portable tool storage and more particularly to a pack system adapted for storing and transporting hand tools.

2. Description of the Prior Art

Carpenters, electricians, facilities maintenance personnel, and other workers often use a tool belt or pouch to hold tools. One example is a tool pouch attached to a tool belt and is designed to hold a small number of tools. One example is an electrician's pouch configured for wire cutters, screwdrivers, and a small number of other tools. A larger tool apron or tool belt is often used on the job in the construction trades.

Tool containers have also been developed for transporting and storing hand tools. Many such containers have been developed and include tool boxes and tool bags made of rigid and pliable materials. For workers who frequently climb structures, backpacks have been developed to hold a variety of tools while the worker climbs and to present the tools in an easy-to-access arrangement for use when the worker reaches the ultimate work site.

One tool backpack is the Tradesman Pro Backpack made by Klein Tools. The Tradesman Pro backpack includes dozens of pockets for tool storage, zipper pouches for small parts, and a hard-molded front pocket for safety glasses and other breakable items. The backpack is worn on the user's back using shoulder straps as is traditionally done with other backpacks. Upon reaching the worksite, the user removes the backpack and unzips the main zipper that extends along the sides and top of the backpack to open the front and rear halves that are connected along a bottom panel. The user may then fold open the front and rear halves of the backpack to display the tools for use. The compartment and storage slots of the Klein Tools backpack are not customizable for specific tools.

For different trades, other manufacturers make tool backpacks that are designed for specific trades or to hold specific tools. Some soft-sided bags, particularly those designed for photographic equipment, feature removable partitions. For example, camera bags have foam partitions that attach along the walls of the bag using a hook-and-loop fastener. The user may change the size and number of sub-compartments within the tool bag by removing or configuring the partitions as needed.

SUMMARY OF THE INVENTION

Although tool backpacks of the prior art may be well built and feature ample tool storage, these backpacks are designed for transporting and using specific tools contained inside the backpack. In other words, these backpacks cannot be reconfigured by the user to carry tools that are not part of specific design. The prior-art backpacks, however, also have not been made with customizable tool storage or removable tool panels. Further, these prior-art backpacks have not addressed the problem of dropped tools or of dropping the backpack itself.

Workers on oil drilling platforms, wind turbines, and other jobsites may climb ladders, towers, and other structures to reach equipment to be serviced or repaired. When the working at height, the worker risks inadvertently dropping individual tools or the entire backpack. Dropped objects can damage equipment and injure or kill workers below.

Thus, a need exists for an improved pack system for hand tools that can be customized and that features tether attachment points for hand tools. The present invention achieves these and other objectives by providing a pack system with one or more tool panels that are removable from the main storage compartment of a tool-carrying container.

In one embodiment, a pack system adapted for carrying hand tools includes a tool-carrying container constructed to be worn on a user's person. The tool-carrying container has a container base portion, a first shell portion, a second shell portion, and a releasable closure with a first closure part connected to the first shell portion and a second closure part connected the second shell portion, where the tool-carrying container is operable between an open-container position and a closed-container position and in the closed-container position defines and encloses a main storage compartment. At least one tool panel is removably disposed within the main storage compartment. Each tool panel has a tool panel side portion and a tool panel lower end portion. Each tool panel also has one or more tool receivers constructed to retain a hand tool. The pack system also includes a panel-retaining structure with a first retaining portion secured to tool panel(s) and a second retaining portion secured to an inside surface of the tool-carrying container. The panel-retaining structure is constructed to releasably retain the tool panel(s) in the main storage compartment.

In one embodiment, the first retaining portion is secured to the tool panel lower end portion.

In one embodiment, the first retaining portion includes a plurality of loops extending from the tool panel lower end portion and the second retaining portion includes a retaining base secured to the container base portion and a retaining bar removably secured to the retaining base and receivable through the plurality of loops. In some embodiments, the second retaining portion structure further includes a second plurality of loops connected to and extending from the retaining base, where the second plurality of loops is constructed to align with the plurality of loops extending from the tool panel lower end portion and to receive the retaining bar therethrough.

In some embodiments, the retaining bar has an end portion defining an opening and the panel-retaining structure includes a releasable connector attached between the retaining base and the opening in the bar end portion.

In some embodiments, the panel-retaining structure is selected as (i) at least one latch plate and a buckle for each latch plate, where each buckle releasably engages one latch plate, (ii) a hook-and-loop fastener with a hook portion or a loop portion connected to the container base portion and the other of the hook portion or the loop portion connected to the tool panel lower end portion, (iii) a zipper with a first zipper part connected to the container base portion and a second zipper part connected to the tool panel lower end portion, (iv) a bar connected to the container base portion and one or more closed-loop connectors connected to the tool panel lower end portion, and (v) a plurality of closed-loop connectors connectable between the container base portion and the tool panel lower end portion.

In some embodiments, the tool-carrying container includes a tether with tether body extending between a first end portion and a second end portion, and having an auxiliary tether portion extending from the tether body to a closed loop distinct from the second end portion. The first end portion is secured to the tool-carrying container and the second end portion has a connector constructed to engage the closed loop on the auxiliary tether portion. In some embodiments, the first end portion of the tether is secured to an inside of the container base portion. In some embodiments, the closed loop on the auxiliary tether portion is a closed-loop connector.

In another embodiment, the pack system includes a second panel-retaining structure attached between a side portion of one or more of the tool panels and the first or second portion of the tool-carrying container. In some embodiments, the second panel-retaining structure is attached to a back panel of the first shell portion, wherein the back panel is constructed to abut a user's back when the tool-carrying container is worn on the user's person.

In another embodiment, the pack system includes an additional panel-retaining structure with a first additional retaining portion secured to the tool panel side portion of one or more of the at least one tool panel and a second additional retaining portion secured to a side portion of an additional tool panel, where the additional panel-retaining structure is constructed to releasably secure the additional tool panel to another tool panel.

In another embodiment, the tool-carrying container is a backpack, a waist pack, a sling pack, or a shoulder pack. In some embodiments, the first shell portion and/or the second shell portion are made of a pliable material. In other embodiments, the container base portion is made of a pliable material.

In another embodiment, one or more tool panel defines a panel opening adjacent a perimeter.

DETAILED DESCRIPTION OF THE PREFERRED EMBODIMENT

Figure 1:
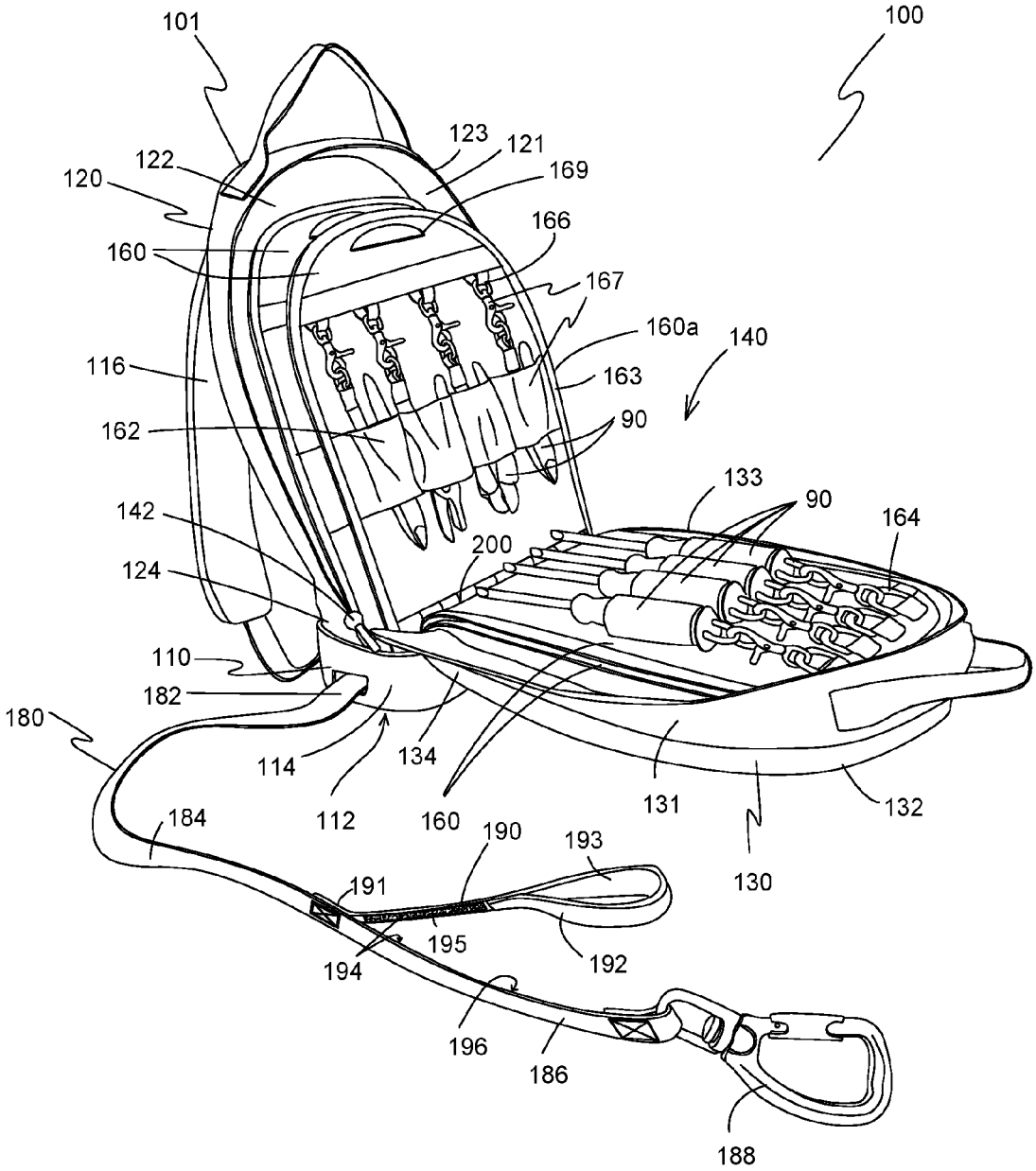
FIG. 1 is a perspective view of one embodiment of a pack system of the present invention shown in an open-container position with a plurality of tool panels attached to an inside of the container base portion and with an optional tether extending from the container base portion of the tool-carrying container.

The preferred embodiments of the present invention are illustrated in FIGS. 1-7. FIG. 1 illustrates a front perspective view of one embodiment of a pack system 100 adapted for carrying hand tools. Pack system 100 includes a tool-carrying container 101 with one or more tool panel 160 removably disposed in the tool-carrying container 101. While illustrated in the Figures as a backpack made of a pliable material, tool-carrying container 101 alternately can be a sling pack, a waist pack, a shoulder pack, a hip pack, or other container that is constructed to be worn on the user's person.

Shown in an open position, tool-carrying container 101 includes a container base portion 110, a first shell portion 120, and a second shell portion 130. First and second shell portions 120, 130 connect to and extend from container base portion 110 to define and enclose a main storage compartment 140 when tool-carrying container 101 is in the closed position (shown, e.g. in FIG. 6). In some embodiments, one or more shoulder straps 116 enable pack system 100 to be worn on the user's person with a first container panel 122 positioned against the user's back. An optional tether 180 is anchored to tool-carrying container 101 for tethering tool-carrying container 101 to a structure when not being worn by the user. Tether 180 may be anchored at any location to tool-carrying container 101, such as inside of container base portion 110, or along top or side of first or second shell portion 120, 130. Tether 180 may also be used to secure one or more tool panel 160 when the tool panel(s) 160 are removed from tool-carrying container 101, such as tethering tool-carrying container 101 and panel(s) 160 to a structure.

In one embodiment, container base portion 110 includes a floor portion 112 and a perimeter base sidewall 114 extending up from floor portion 112. In one embodiment, container base portion 110 defines a relatively shallow tray with an open top. In one embodiment, container base portion 110 is made of molded rubber, canvas, vinyl, ballistic nylon, leather, or the like. Since pack system 100 is intended to hold many hand tools 90 with a significant combined weight, container base portion 110 of tool-carrying container 101 is made of a durable material to resist wear and tear when pack system 100 is dragged, dropped, moved, used, and abused while fully loaded.

In some embodiments, first shell portion 120 has first container panel 122 or back container panel 122 with a first sidewall portion 121 extending transversely away from first container panel 122 to a first rim 123. When tool-carrying container 101 is a backpack, sling pack, or the like, first container panel 122 typically rests against the user's back when tool-carrying container 101 is worn by the user. Similarly, second shell portion 130 has a second panel 132 with a second sidewall portion 131 extending transversely away from second panel 132 to a second rim 133. Second panel 132 is spaced apart from and generally parallel to first container panel 122. In one embodiment, first and second shell portions 120, 130 are made of a pliable material, such as ballistic nylon, canvas, leather, or rubberized textiles. Hard plastic, metal, fiberglass, and other materials with a predefined form are also acceptable.

Figure 6:
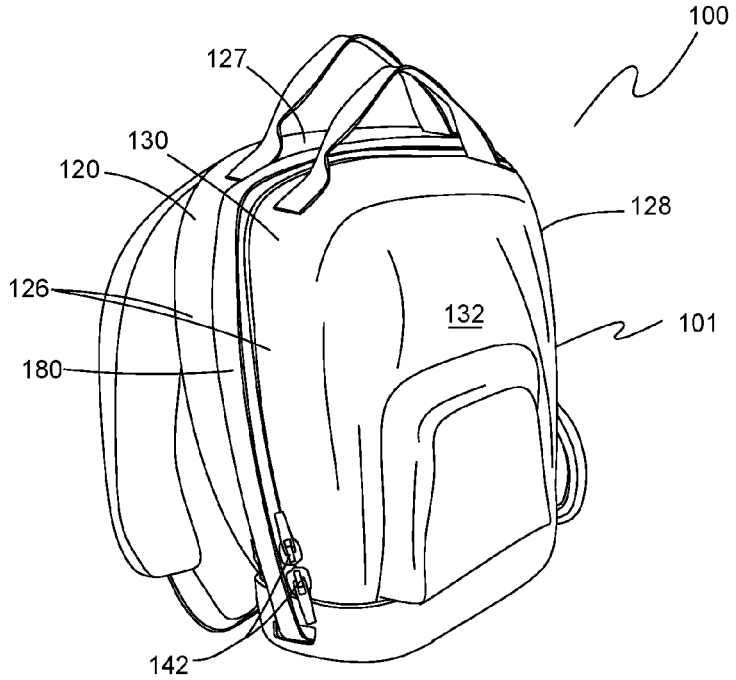
FIG. 6 illustrates a perspective view of one embodiment of a pack system of the present invention shown in a closed-container position.

A releasable closure 142 is installed between first shell portion 120 and second shell portion 130 and operates between an open closure position and a closed closure position (shown, e.g., in FIG. 6). For example, releasable closure 142 extends along first rim 122 and second rim 132 to maintain tool-carrying container 101 in a closed pack position as shown in FIG. 6. In some embodiments, releasable closure 142 is a heavy-duty zipper, a series of flaps with hook-and-loop fasteners, straps with or without fasteners, clasps, or other closure between first and second shell portions 120, 130. Thus, first rim 122 and second rim 132 can be brought together in alignment and fastened with releasable closure 142 so that first shell portion 120 and second shell portion 130 enclose main storage compartment 140. In an open position, first shell portion 120 and second shell portion 130 are able to rotate or fold away from each other for access to main storage compartment 140. In one embodiment, first and second shell portions 120, 130 fold open in a 180° relationship to lay flat on the ground for convenient access to hand tools 90 as shown, for example, in FIG. 7.

A first lower end portion 124 of first shell portion 120 and a second lower end portion 134 of second shell portion 130 are secured to container base portion 110. In one embodiment, for example, first and second lower end portions 124, 134 are stitched to base along base sidewall 114. In another embodiment, first and second shell portions 120, 130 are continuous with each other and include an end portion (not shown) extending between and connecting first lower end portion 124 and second lower end portion 134. For example, the end portion extends into container base portion 110 and along floor portion 112 where it can be fixed to container base portion 110 by adhesive, rivets, grommets, or a clamping plate fastened to container base portion 110. For example, the end portion extends between a clamping plate and floor portion 112, where fasteners extend through the clamping plate, floor 112, and end portion. One embodiment of clamping plate is discussed below with reference to FIG. 4.

The one or more removable tool panels 160 of pack system 100 are removably disposed in main storage compartment 140 of tool-carrying container 101. Each removable tool panel 160 is attached to tool-carrying container 101 by a panel-retaining structure 200 connected between tool panel 160 and tool-carrying container 101. Depending on the desired layout of tool panels 160, panel-retaining structure 200 may be attached between a tool panel lower end portion 161 and container base portion 110 or between a tool panel side portion 163 and a sidewall portion 121/131 of tool-carrying container 101 (or to tool panel side portion 163 of another tool panel 160). Thus, one tool panel 160 may fold or rotate about panel-retaining structure 200 attached to container base portion 110 and another tool panel 160 may fold or rotate about panel-retaining structure 200 attached to first sidewall portion 121, second sidewall portion 131, first container panel 122, second container panel 132, or another tool panel 160. Examples of panel-retaining structure 200 are discussed in more detail below.

Each tool panel 160 is a comparatively thin, flat and generally planar structure that is shaped to be received in main storage compartment 140. Each tool panel 160 is removably attached to tool-carrying container 101 in a way that allows tool panel 160 to rotate or swing about panel-retaining structure 200 for access to one or more hand tools 90 retained by a tool receiver 167 on tool panel 160. Each tool panel 160 is useful as a partition and as a storage panel for storing one or more hand tools 90. For example, a tool receiver 167 is a slot 162, loop 164, anchor point 166, or other feature as needed for holding, tying off, and/or retaining a hand tool 90 or other equipment to tool panel 160.

In one embodiment, tool panels 160 are made of a rigid material and have a shape similar to the profile shape of main storage compartment 140. Tool panels 160 may be made of plastic, metal, fiberglass, wood, or other materials. In one embodiment, tool panels 160 are made of Lexan™ polycarbonate resin sheeting with a thickness of about 0.06 inch. Other materials and thicknesses are also acceptable. In one embodiment, tool panels 160 have with a rigidity sufficient to prevent tool panel 160 from folding on itself or crumpling inside tool-carrying container 101 under the weight of hand tools 90 attached to it. In other embodiments, tool panels 160 have a rigid frame secured to a durable fabric or web extending across the area enclosed by the frame.

In some embodiments, tool panels 160 optionally define a panel opening 169 positioned along a perimeter 160*a* of tool panel 160. Panel opening 169 is useful for carrying tool panel 160 and/or for tethering tool panel 160 to a structure 250. In one embodiment, panel opening 169 is sized for the user's hand to grasp and carry tool panel 160.

In one embodiment, an optional tether 180 is secured to tool-carrying container 101. Tether 180 is made of a pliable material such as nylon webbing, leather, plastic, rope, or paracord. Tether 180 has a first tether end portion 182 secured to tool-carrying container 101 and extending along a tether body portion 184 to a second tether end portion 186. An auxiliary loop member 190 has a first auxiliary end portion 191 and a second auxiliary end portion 192, where second auxiliary end portion 192 defines a closed loop 193. In some embodiments, second tether end portion 186 has a connector 188 constructed to engage closed loop 193 of auxiliary loop member 190. In one embodiment, closed loop 193 is formed by securing second auxiliary end portion 192 to itself. In other embodiments, closed loop 193 is a closed loop of a connector, ring, or other structure secured to second auxiliary end portion 192.

Auxiliary loop member 190 is a separate length of pliable material that extends from tether body portion 184. For example, auxiliary loop member 190 is secured at first auxiliary end portion 191 to tether body portion 184 and extending in a Y with second tether end portion 186. Auxiliary loop member 190 may be aligned with and abut tether strap 180 along at least part of its length. In some embodiments, tether 180 includes a releasable fastener 194 with a first fastener part 195 and a second fastener part 196. For example, auxiliary loop member 190 includes a first fastener part 195 and the corresponding section of tether 180 includes a second fastener part 196 of releasable fastener 194. In one embodiment, releasable fastener 194 is a hook-and-loop fastener where first fastener part 195 is the hook portion secured along tether 180 adjacent second tether end portion 186, and second fastener part 196 is the loop portion secured along auxiliary loop member 190 or vice versa. Other acceptable variants of releasable fastener 194 include magnets, snaps, buttons, or other fasteners. When auxiliary loop member 190 extends along and is brought together in alignment with tether body portion 184, first and second fastener parts 195, 196 are aligned for fastening to each other. Releasably attaching auxiliary loop member 190 to tether body portion 184 retains auxiliary loop member 190 in a stowed position where it is less prone to inadvertently catching on equipment or structures.

Second tether end portion 186 may be looped around a structure 250 (shown in FIG. 7) to attach connector 188 to closed loop 193 of auxiliary loop member 192. Tether 180 may also be used to secure one or more tool panels 160 after removal from tool-carrying container 101. For example, tether 180 is attached through panel opening 169 or passed through panel opening 169 when looping tether to structure 250. When not used for tethering tool-carrying container 101 or tool panel 160 removed from tool-carrying container 101, tether 180 may be stored in main storage compartment 140, in an outside pocket, or in another location on tool-carrying container 101. In some embodiments, tether 180 is stowed by looping over tool-carrying container 101 as shown, for example, in FIG. 6 and optionally securing tether 180 to tool-carrying container 101 with retaining loops or other device as desired. In yet other embodiments, tether 180 is connected to a retractor located in container base portion 110.

Referring now to FIGS. 2-5, embodiments are shown of panel-retaining structure 200 attached between tool panel 160 and container base portion 110. In some embodiments, panel-retaining structure 200 includes a first retaining part 202 on tool panel 260 and a second retaining part 210 fixedly attached to tool-carrying container 101 or another tool panel 260. In other embodiments, panel-retaining structure 200 includes additional components. Although embodiments of panel-retaining structure 200 of FIGS. 2-5 are shown attached to container base portion 110, the various embodiments of panel-retaining structures 200 could similarly be attached between tool panel side portion 163 and container panel 122/132 or sidewall portion 121, 131 of tool-carrying container 101 as illustrated, for example, in FIG. 7.

Figure 2:
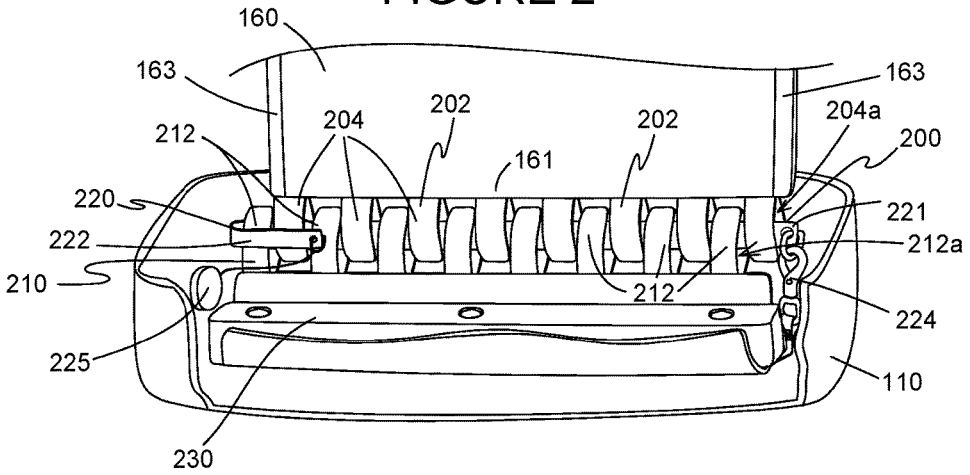
FIG. 2 illustrates an embodiment of the container base portion of the pack system of the present invention shown partially cut away, a portion of a tool panel, and one embodiment of a retaining structure that includes loops on the tool panel, loops connected to the container base portion and a retaining pin or retaining bar installed through the loops.

FIG. 2 illustrates a front perspective view of an example of container base portion 110, a portion of tool panel 160, and one embodiment of panel-retaining structure 200 between tool panel 160 and container base portion 110. Container base portion 110 is shown partially cut away to more clearly show panel-retaining structure 200. Panel-retaining structure 200 has a first retaining part 202 formed in or secured to tool panel 160. First retaining part 202 engages a second retaining part 210. In the embodiment shown in FIG. 2, first retaining part 202 of panel-retaining structure 200 includes a plurality of first loops 204 extending from a tool panel lower end portion 161. In one embodiment, first loops 204 are spaced apart and distributed along tool panel lower end portion 161 of tool panel 160.

A second retaining part 210 of panel-retaining structure 200 is attached to container base portion 110. In one embodiment, second retaining part 210 includes a plurality of second loops 212 secured to and extending from container base portion 110, where first loops 204 and second loops 212 can be brought together in alignment and interspersed, where first loop openings 204*a* of first loops 204 are aligned with second loop openings 212*a* of second loop 212. As such, a retaining pin 220 can be removably installed through first and second loop openings 204*a*, 212*a*. As needed, retaining pin 220 is secured to container base portion 110 or otherwise structured to prevent its removal from first and second loops 204, 212. For example, a connector 224 engages first pin end 221 and/or second pin end 222 and prevents removal of retaining pin 220. For example, connector 224 is a spring clip that is tethered to container base portion 110 with a connector tether 223. Connector tether 223 has a short length sized to prevent removal of retaining pin 220 from first and second loops 204, 212 when connector 224 is attached to retaining pin 220. To prevent loss of retaining pin 220 when it is not in use with tool panel 160, or to prevent inadvertent dropping of retaining pin 220 during removal of tool panel 160, an optional retractable tether 225 secured to tool-carrying container 101 may be used to tether retaining pin 220. Retractable tether 225 may be anchored to an outside or inside of container base portion 101, first shell 120, second shell 130, or to any other portion of tool-carrying container 101. In one embodiment, tool-carrying container features one or more longitudinal pockets for storing retaining pin(s) 220 when not in use.

In one embodiment, second pin end 222 curves back along retaining pin 220 in a U-shape that extends outside of first and second loops 204, 212. In yet other embodiments, first pin end 221 and/or second pin end 222 has a size that is greater than first loop openings 204*a* and second loop openings 212*a*, where one or both of first pin end 221 and second pin end 222 are removable or alterable to allow retaining pin 220 to pass through first and second loops 204, 212 during installation and removal. For example, first pin end 221 and second pin end 222 have a T-shape or L-shape that must be rotated to align with first loop openings 204*a* and second loop openings 212*a* before retaining pin 220 can be installed or removed. Similar to a hinge, retaining pin 220 prevents separation of first loops 204 from second loops 212 to retain tool panel 160 with container base portion 110 and permit tool panel 160 to rotate about retaining pin 220 for access to hand tools 90 on either face of tool panel 160.

In one embodiment, all of first loops 204 have the same size and are spaced apart and evenly distributed along tool panel lower end portion 161. Second loops 212 are sized and spaced to fit in the space between adjacent first loops 204. Optionally second loops 212 are positioned at each end of the series of first loops 204 as "bookends" to first loops 204.

In one embodiment, first loops 204 are formed when making tool panel 160 from a sheet of material. For example, a sheet of polycarbonate resin is folded in half and then the folded sheet is shaped to define tool panel 160 to fit in main storage compartment 140. The end of the folded sheet is notched along the fold to define loops along tool panel lower end portion 161. The tool panel 160 is stitched together above the loops and along the edges. Thus, tool panel 160 is defined with first loops 204 extending from tool panel lower end portion 161, where each of first loops 204 has first loop opening 204*a*. Second loops 212 may be similarly formed from a sheet that extends below base plate 230 or is otherwise secured to container base portion 110, such as by stitching or fasteners in floor portion 112. In one embodiment, the sheet extends beneath and is trapped by base plate 230, where the sheet defines a set of second loops 212 on one side of base plate 230 and an additional set (not shown) of second loops 212 on the other side of base plate 230. In some embodiments, container base portion 110 has a plurality of sets of second loops 212 to accommodate a plurality of tool panels 160. In other embodiments, second loops 212 are wire loops, metal strap formed into loops, closed-loop connectors, flexible straps, webbing, or other material secured to a base plate 230 in container base portion 110.

Figure 3:
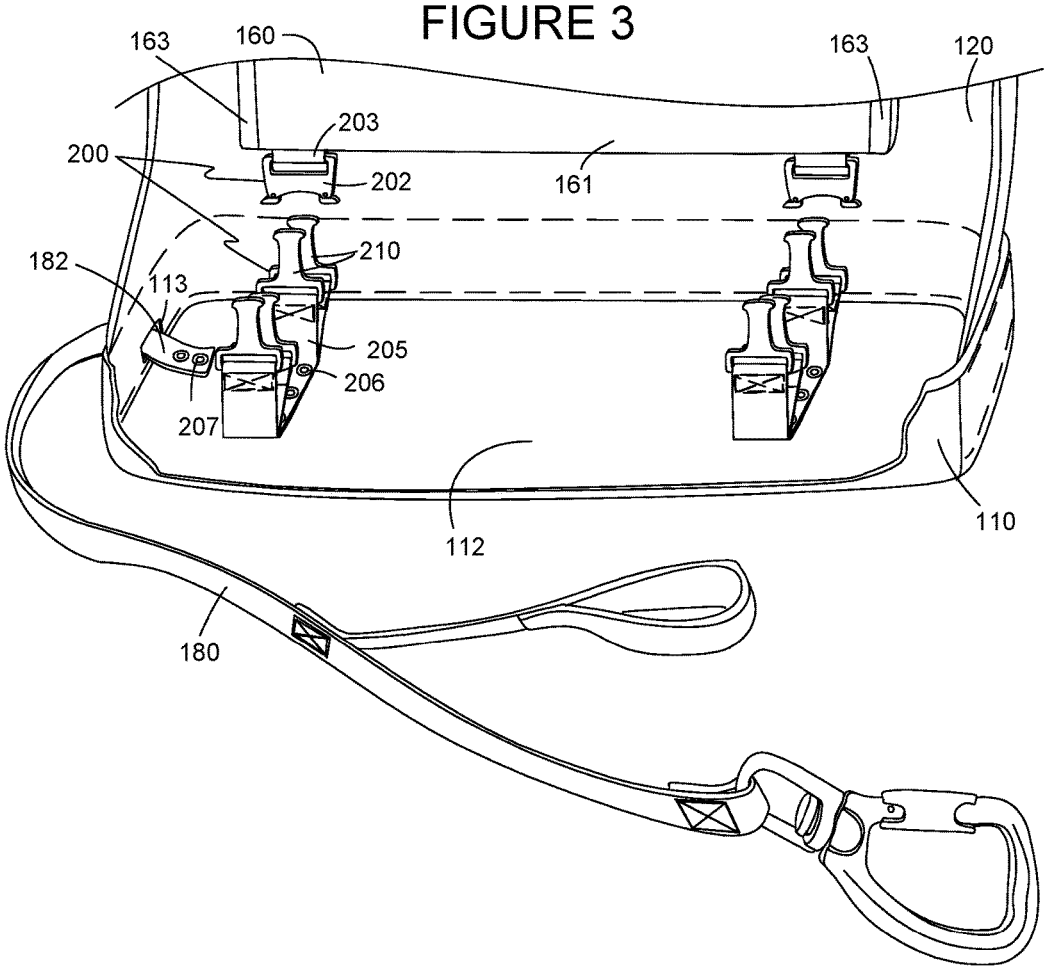
FIG. 3 illustrates an embodiment of the container base portion of a pack system of the present invention shown partially cut away, a portion of a tool panel, and another embodiment of a retaining structure that includes buckles and latch plates, where buckles are attached to the tool panel and latch plates are attached to the floor of the container base portion.

Referring now to FIG. 3, a front perspective view illustrates container base portion 110 with a portion of first shell portion 120, a portion of tool panel 160, and another embodiment of panel-retaining structure 200 comprising load-bearing buckles or other fastener. For example, first retaining part 202 includes a plurality of quick-release buckles and second retaining part 210 is a corresponding plurality of latch plates that are received by the quick-release buckles. First retaining part 202 (e.g., buckles or latch plates) is secured to tool panel lower end portion 161 by webbing 203 or the like. In other embodiments, first retaining part 202 is built into or fixedly attached to tool panel lower end portion 161. Second retaining part 210 (e.g., corresponding latch plates or buckles) are secured to floor portion 112 of container base portion 110. In one embodiment, a length of webbing 205 is attached to second retaining part 210 (e.g., latch plates) and fixedly attached to floor portion 112 using fasteners 206, or base plate 230.

FIG. 3 also shows first tether end portion 182 of tether 180 extending through tether opening 113 in container base portion 110. In one embodiment as shown, first tether end portion 182 is secured to floor portion 112 of container base portion 110 by fasteners 207. Other appropriate attachment methods are acceptable.

Figure 4:
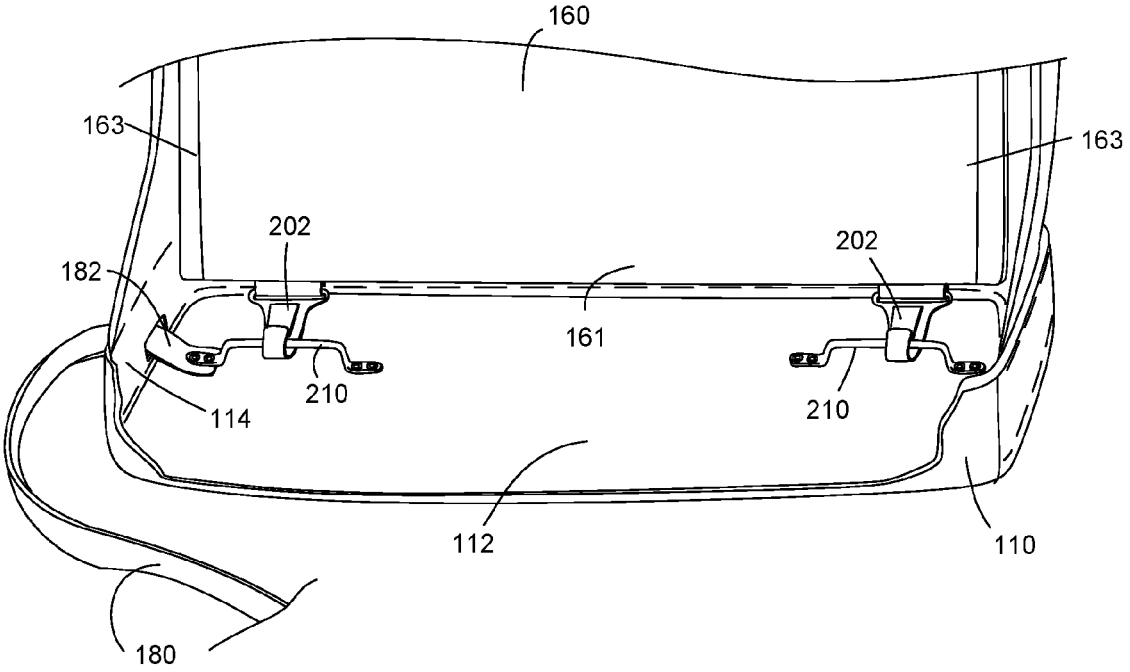
FIG. 4 illustrates an embodiment of the container base portion of a pack system of the present invention shown partially cut away, a portion of a tool panel, and another embodiment of a retaining structure that includes spring-hook connectors attached to the lower end portion of the tool panel that engage loops connected to the base portion.

Referring now to FIG. 4, a front perspective view of container base portion 110 shows another embodiment of panel-retaining structure 200 between container base portion 110 (shown partially cut away) and tool panel 160. In the embodiment of FIG. 4, first retaining part 202 is a plurality of closed-loop connectors attached to tool panel 160 along tool panel lower end portion 161. For example, first retaining part 202 is a plurality of latch hooks attached to tool panel lower end portion 161. Second retaining part 210 is one or more of an anchor ring or an anchor bar attached to container base portion 110. In one embodiment, second retaining part 210 is attached to floor portion 212; second retaining part 210 could also be attached to base sidewall 114. First retaining part 202 can be any closed-loop connector, such as a carabiner, spring clip, shackle, screw link, spring hook, or other connector. In one embodiment, second retaining part 210 attaches to floor portion 112 while also securing first tether end portion 182 of tether 180.

Figure 5:
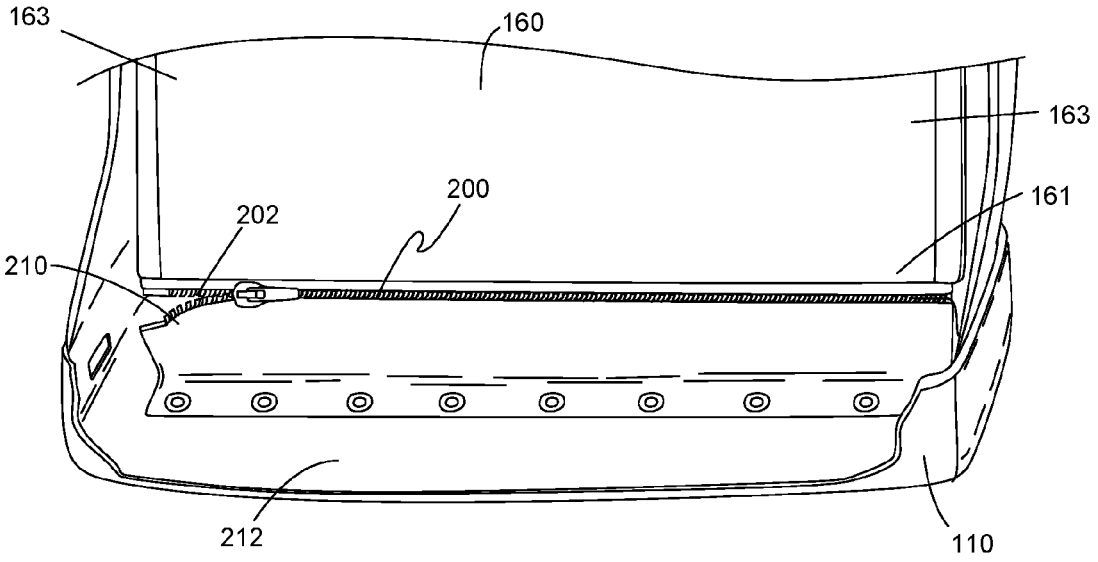
FIG. 5 illustrates an embodiment of the container base portion of a pack system of the present invention shown partially cut away, a portion of a tool panel, and another embodiment of a retaining structure that includes a zipper.

Referring now to FIG. 5, a front perspective view of container base portion 110 shows another embodiment of panel-retaining structure 200 between container base portion 110 (shown partially cut away) and tool panel 160. In the embodiment of FIG. 5, first retaining part 202 is a first zipper part and second retaining part 210 is a second zipper part secured to floor portion 212. In yet other embodiments, first retaining part 202 is a strip of hooks or loops of a hook-and-loop fastener and second retaining part 210 is the other mating part of the hook-and-loop fastener.

Referring now to FIG. 6, a perspective view illustrates one embodiment of pack system 100 with tool-carrying container 101 in a closed pack position with first shell portion 120 attached to second shell portion 130 using releasable closure 142 (e.g., a zipper) in the closed closure position. Tether 180 is shown in one example of a stowed position where tether 180 exits tether opening 113 and then loops up along first side portion 126, over top portion 127, and down along second side portion 128. Tool panels 160 with hand tools 90 (shown in FIG. 1) are retained within main storage compartment 140 of tool-carrying container 101.

Figure 7:
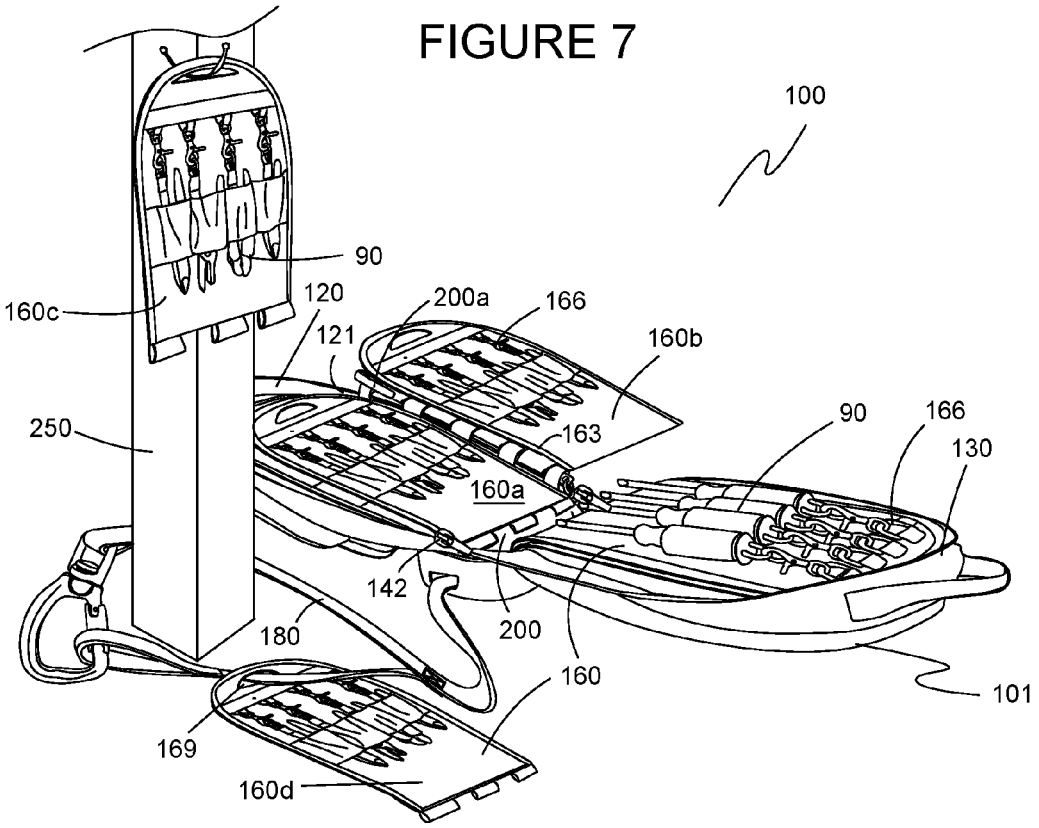
FIG. 7 illustrates a perspective view of one embodiment of a pack system of the present invention shown in use with the tether secured around a post and tool panels in various positions connected to and disconnected from the tool-carrying container.

Referring now to FIG. 7, one embodiment of pack system 100 is shown in use. Releasable closure 142 is in the open closure position to allow first shell portion 120 and second shell portion 130 to open away from each other and lay flat on the ground to present the plurality of hand tools 90 to the user. Tool panels 160 may be folded or rotated about panel-retaining structure 200 for access to the plurality of hand tools 90 on the various tool panels 160. An additional panel-retaining structure 200*a* connects tool panel 160*b* to tool panel 160*a*. Tool panel 160*b* is rotated out of tool-carrying container 101 along additional panel-retaining structure 200*a* attached to tool panel side portion 163 of tool panel 160*b* and to first sidewall portion 121.

Individual tool panels 160 may be removed from tool-carrying container 101 as desired and hung at the worksite for further improved access to hand tools 90. As illustrated, tool panel 160*c* has been removed from tool-carrying container 101 and is hanging on structure 250. Tool panel 160*d* is tethered with tether 180 extending through panel opening 169. Tool-carrying container 101 is tethered to structure 250 and each hand tool 90 is tethered to a tool panel 160 using a connector and anchor point 166 on tool panel 160. As such, embodiments of pack system 100 allow the user to transport hand tools 90 with the ability to reduce or prevent accidental equipment drops of tool-carrying container 101 or individual hand tools 90.

By appropriately equipping tool-carrying container 101 with a sufficient quantity of retractable tethers 225, loops 164, and/or anchor points 166, the user of pack system 100 may achieve 100% tie-off of hand tools 90, tool panels 160, other equipment stored in tool-carrying container 101, and tool-carrying container 101 itself.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A pack system adapted for carrying hand tools comprising:

a tool-carrying container constructed to be worn on an user's person, the tool-carrying container having a container base portion interconnecting a first shell portion and a second shell portion, and a releasable closure with a first closure part connected to the first shell portion and a second closure part connected the second shell portion, wherein the tool-carrying container is operable between an open-container position and a closed-container position and in the closed-container position defines and encloses a main storage compartment;

at least one tool panel with one or more tool receivers each constructed to retain a hand tool, the at least one tool panel having a tool panel side portion and a tool panel lower end portion, wherein the at least one tool panel is removably disposed within the main storage compartment;

a panel-retaining structure with a first retaining portion secured to the at least one tool panel and a second retaining portion secured to an inside surface of the tool-carrying container, wherein the panel-retaining structure is constructed to releasably retain the at least one tool panel in the main storage compartment; and a tether strap having a tether body extending between a first body end portion and a second body end portion and an auxiliary tether portion extending between a first auxiliary end portion and a second auxiliary end portion, wherein the first body end portion of the tether body is secured to an inside of the container base portion, wherein the second body end portion of the tether strap is accessible to an outside of the container base portion through a tether opening in the container base portion, wherein the first auxiliary end portion is secured to the tether body proximate the second body end portion, and wherein the second auxiliary end portion and the second body end portion are configured and arranged to releasably connect.

2. The pack system of claim 1, wherein the first retaining portion is secured to the tool panel lower end portion.

3. The pack system of claim 1, wherein the first retaining portion comprises a plurality of loops extending from the tool panel lower end portion and wherein the second retaining portion comprises a retaining base secured to the container base portion and a retaining bar removably secured to the retaining base and receivable through the plurality of loops.

4. The pack system of claim 3, wherein the second retaining portion further comprises a second plurality of loops connected to and extending from the retaining base, wherein the second plurality of loops is constructed to align with the plurality of loops extending from the tool panel lower end portion and to receive the retaining bar therethrough.

5. The pack system of claim 3, wherein the retaining bar has a first bar end portion defining an opening and wherein the panel-retaining structure further comprises a releasable connector attached between the retaining base and the opening in the first bar end.

6. The pack system of claim 1, wherein the panel-retaining structure is selected from the group consisting of (i) at least one latch plate and a buckle to releasably engage each of the at least one latch plate, (ii) a hook-and-loop fastener with a hook portion or a loop portion connected to the container base portion and a mating other of the hook portion or the loop portion connected to the tool panel lower end portion, (iii) a zipper with a first zipper part connected to the container base portion and a second zipper part connected to the tool panel lower end portion, (iv) a bar connected to the container base portion and one or more closed-loop connectors connected to the tool panel lower end portion, and (v) a plurality of closed-loop connectors connectable between the container base portion and the tool panel lower end portion.

7. The pack system of claim 1, wherein the auxiliary tether portion extends from the tether body and forms a closed loop distinct from the second body end portion; and a connector is secured along the second body end portion which is constructed to engage the closed loop on the auxiliary tether portion.

8. The pack system of claim 1, wherein when in the open container position, a fist tool panel is adjacent the first shell portion; a second tool panel is adjacent the second shell portion; and the first shell portion and the second shell portion are in an 180° relationship.

9. The pack system of claim 7, wherein the closed loop on the auxiliary tether portion is a closed-loop connector.

10. The pack system of claim 1 further comprising a second panel-retaining structure attached between a side portion of one or more of the at least one tool panel and the first shell portion or the second shell portion.

11. The pack system of claim 10, wherein the second panel-retaining structure is attached to a back panel of the first shell portion, wherein the back panel is constructed to abut an user's back when the tool-carrying container is worn on the user's person.

12. The pack system of claim 1, further comprising an additional panel-retaining structure with a first additional retaining portion secured to the tool panel side portion of one or more of the at least one tool panel and a second additional retaining portion secured to a side portion of an additional tool panel, wherein the additional panel-retaining structure is constructed to releasably secure the additional tool panel to one of the at least one tool panel.

13. The pack system of claim 1, wherein the tool-carrying container is selected from the group consisting of a backpack, a waist pack, a sling pack, and a shoulder pack.

14. The pack system of claim 13, wherein the first shell portion and the second shell portion are made of a pliable material.

15. The pack system of claim 1, wherein each of the at least one tool panel defines a panel opening adjacent a perimeter.

16. A tool carrying apparatus comprising:

a tool-carrying container having:

a container base portion;

a first shell portion connected to the container base portion;

a second shell portion connected to the container base portion opposite the first shell portion; and a releasable closure portion having: a first closure part connecting to the first shell portion, and a second closure part connecting to the second shell portion;

wherein the first shell portion releasably connects to the second shell portion via the first closure part interacting with the second closure part, such that the tool-carrying container is operable between a closed-container position and an open-container position; and wherein the closed-container position defines and encloses a main storage compartment;

a plurality of tool panels having a plurality of tool receivers, each of the plurality of tool receivers capable of releasably retaining a hand tool within the main storage compartment;

a panel-retaining structure having: a plurality of retaining portions, wherein a first retaining portion rotatably and releasably secured a respective one of the plurality of tool panels, and a second retaining portion is secured to an inside surface of the tool carrying container; and a tether strap having a tether body extending between a first body end portion and a second body end portion and an auxiliary tether portion extending between a first auxiliary end portion and a second auxiliary end portion, wherein the first body end portion of the tether body is secured to an inside of the container base portion, wherein the second body end portion of the tether strap is accessible to an outside of the container base portion through a tether opening in the container base portion, wherein the first auxiliary end portion is secured to the tether body proximate the second body end portion, and wherein the second auxiliary end portion and the second body end portion are configured and arranged to releasably connect.

17. The pack system of claim 16, wherein the plurality of tool panels has at least a first, second, and third tool panel, such that: the first tool panel is adjacent the first shell portion; the second tool panel is adjacent the second shell portion; the third tool panel is between the first and the second tool panels; and when in the open-container position, the first tool panel and the second tool panel are rotated into an 180° relationship.

18. The pack system of claim 16, wherein the auxiliary tether portion extends from the tether body and forms a closed loop distinct from the second body end portion, and a connector is secured along the second body end portion and is constructed to engage the closed loop on the auxiliary tether portion.

* * * * *